US006314836B1

(12) United States Patent
Einset et al.

(10) Patent No.: US 6,314,836 B1
(45) Date of Patent: Nov. 13, 2001

(54) WIRE DRAWING DIE WITH NON-CYLINDRICAL INTERFACE CONFIGURATION FOR REDUCING STRESSES

(75) Inventors: Erik O. Einset, Delaware; David M. Johnson, Westerville, both of OH (US)

(73) Assignee: General Electric Company, Pittsfield, MA (US)

( * ) Notice: Subject to any disclaimer, the term of this patent is extended or adjusted under 35 U.S.C. 154(b) by 0 days.

(21) Appl. No.: 09/358,271

(22) Filed: Jul. 21, 1999

Related U.S. Application Data

(62) Division of application No. 08/950,004, filed on Oct. 14, 1997.

(51) Int. Cl.[7] ..... B21C 3/02
(52) U.S. Cl. ..... 76/107.4; 72/467
(58) Field of Search ..... 76/107.4; 72/467

(56) References Cited

U.S. PATENT DOCUMENTS

| | | | |
|---|---|---|---|
| 354,991 | | 12/1886 | Straup . |
| 1,395,217 | | 10/1921 | Begot . |
| 2,941,241 | | 6/1960 | Strong . |
| 2,941,248 | | 6/1960 | Hall . |
| 2,947,611 | | 8/1960 | Bundy . |
| 3,136,615 | | 1/1964 | Bovenkerk et al. . |
| 3,142,746 | | 7/1964 | Schmerling . |
| 3,233,988 | | 2/1966 | Wentorf, Jr. et al. . |
| 3,381,428 | | 5/1968 | Sillman . |
| 3,433,049 | * | 3/1969 | Naeser et al. ..... 72/467 |
| 3,609,818 | | 10/1971 | Wentorf, Jr. . |
| 3,743,489 | | 7/1973 | Wentorf, Jr. et al. . |
| 3,745,623 | | 7/1973 | Wentorf, Jr. et al. . |
| 3,767,371 | | 10/1973 | Wentorf, Jr. et al. . |
| 3,831,428 | | 8/1974 | Wentorf, Jr. et al. . |
| 3,850,591 | | 11/1974 | Wentorf, Jr. . |
| 3,852,078 | | 12/1974 | Wakatsuki et al. . |
| 3,928,219 | | 12/1975 | Papay et al. . |
| 4,016,736 | | 4/1977 | Carrison et al. . |
| 4,038,858 | | 8/1977 | DeZuba . |
| 4,055,073 | * | 10/1977 | Langr ..... 72/467 |
| 4,063,909 | | 12/1977 | Mitchell . |
| 4,129,052 | | 12/1978 | Bieberich . |
| 4,144,739 | | 3/1979 | Corbin . |
| 4,188,194 | | 2/1980 | Corrigan . |
| 4,260,397 | | 4/1981 | Bovenkerk . |
| 4,289,503 | | 9/1981 | Corrigan . |
| 4,303,442 | | 12/1981 | Hara et al. . |

(List continued on next page.)

*Primary Examiner*—Rinaldi I. Rada
*Assistant Examiner*—Kim Ngoc Tran

(57) ABSTRACT

The present invention is addressed to improving a blank for a wire drawing die formed from an annular cemented metal carbide support component having a lengthwise extent from an entrance end to an exit end and extending radially about a central longitudinal axis to define a cylindrical internal bore through the lengthwise extent, and a cylindrical sintered polycrystalline compact component received within the bore of the support component and bonded thereto at an interface surface extending a radial distance from and along the longitudinal axis from a wire drawing entrance end to a wire drawing exit end. The compact component is adapted to receive an aperture extending through its lengthwise extent about the central longitudinal axis and is configured with an entrance zone at the die entrance end which tapers inwardly therefrom to a reduction zone whereat a wire to be drawn through the aperture makes initial contact with the compact component, and thence to a bearing zone and an exit zone. The improvement in such wire drawing die blank revolves the radial distance from said central longitudinal axis to said interface surface tapers inwardly from the entrance end to a minimum prior to the bearing zone after which said radial distance remains substantially constant to said exit end. The corresponding wire drawing die and the method for producing the inventive wire drawing blank also form additional aspects of the present invention.

5 Claims, 2 Drawing Sheets

U.S. PATENT DOCUMENTS

| | | | | |
|---|---|---|---|---|
| 4,344,928 | | 8/1982 | Dupin et al. . | |
| 4,370,149 | | 1/1983 | Hara et al. . | |
| 4,374,900 | | 2/1983 | Hara et al. . | |
| 4,378,690 | * | 4/1983 | Stiebritz et al. | 72/467 |
| 4,394,170 | | 7/1983 | Sawaoka et al. . | |
| 4,403,015 | | 9/1983 | Nakai et al. . | |
| 4,534,934 | | 8/1985 | Cho . | |
| 4,567,793 | * | 2/1986 | Millner et al. | 76/107 A |
| 4,601,423 | | 7/1986 | Pipkin et al. . | |
| 4,613,740 | * | 9/1986 | Ichikawa | 219/69 W |
| 4,673,414 | | 6/1987 | Lavens et al. . | |
| 4,724,699 | * | 2/1988 | Gavinet et al. | 72/467 |
| 4,797,326 | | 1/1989 | Csillag . | |
| 4,828,611 | | 5/1989 | Nakai et al. . | |
| 4,872,333 | | 10/1989 | Burnand . | |
| 4,954,139 | | 9/1990 | Cerutti . | |
| 5,033,334 | | 7/1991 | Phaal et al. . | |
| 5,634,370 | * | 6/1997 | Anthony et al. | 72/467 |
| 5,636,545 | * | 6/1997 | Anthony et al. | 72/467 |
| 5,648,139 | * | 7/1997 | Sussmann et al. | 428/131 |
| 5,660,075 | | 8/1997 | Johnson et al. . | |
| 5,957,005 | * | 9/1999 | Einset et al. | 76/107.4 |

* cited by examiner

WIRE DRAWING DIE WITH NON-CYLINDRICAL INTERFACE CONFIGURATION FOR REDUCING STRESSES

This is a divisional of co-pending application Ser. No. 08/950,004 filed on Oct. 14, 1997.

CROSS-REFERENCE TO RELATED APPLICATIONS

None.

STATEMENT REGARDING FEDERALLY SPONSORED RESEARCH

Not applicable.

BACKGROUND OF THE INVENTION

The present invention relates to wire drawing dies, and more particularly to dies formed of a cemented metal carbide supported, polycrystalline diamond (PCD) or polycrystalline cubic boron nitride (PCBN) compact wherein a non-cylindrical interface is provided between the compact and the support layers for improved physical properties.

A compact may be characterized generally as an integrally-bonded structure formed of a sintered, polycrystalline mass of abrasive particles, such as diamond or CBN. Although such compacts may be self-bonded without the aid of a bonding matrix or second phase, it generally is preferred, as is discussed in U.S. Pat. Nos. 4,063,909 and 4,60,423, to employ a suitable bonding matrix which usually is a metal such as cobalt, iron, nickel, platinum, titanium, chromium, tantalum, copper, or an alloy or mixture thereof. The bonding matrix, which is provided at from about 5% to 35% by volume, additionally may contain recrystallization or growth catalyst such as aluminum for CBN or cobalt for diamond.

For many applications, it is preferred that the compact is supported by its bonding to substrate material to form a laminate or supported compact arrangement. Typically, the substrate material is provided as a cemented metal carbide which comprises, for example, tungsten, titanium, or tantalum carbide particles, or a mixture thereof, which are bonded together with a binder of between about 6% to about 25% by weight of a metal such as cobalt, nickel, or iron, or a mixture or alloy thereof. As is shown, for example, in U.S. Pat. Nos. 3,381,428; 3,852,078; and 3,876,7512, compacts and supported compacts have found acceptance in a variety of applications as parts or blanks for cutting and dressing tools, as drill bits, and as wear parts or surfaces, The basic HP/HT method for manufacturing the polycrystalline compacts and supported compacts of the type herein involved entails the placing of an unsintered mass of abrasive, crystalline particles, such as diamond or CBN, or a mixture thereof, within a protectively shielded metal enclosure which is disposed within the reaction cell of an HT/HP apparatus of a type described further in U.S. Pat. Nos. 2,947,611; 2,941,241; 2,941,248; 3,609,818; 3,767,371; 4,289,503; 4,673,414; and 4,954,139. Additionally placed in the enclosure with the abrasive particles may be a metal catalyst if the sintering of diamond particles is contemplated, as well as a pre-formed mass of a cemented metal carbide for supporting the abrasive particles and to thereby form a supported compact therewith. The contents of the cell then are subjected to processing conditions selected as sufficient to effect intercrystalline bonding between adjacent grains of abrasive particles and, optionally, the joining of sintered particles to the cemented metal carbide support. Such processing conditions generally involve the imposition for about 3 to 120 minutes of a temperature of at least 1300° C. and a pressure of at least 20 kbar.

Regarding the sintering of polycrystalline diamond compacts or supported compacts, the catalyst metal may be provided in a pre-consolidated form disposed adjacent the crystal particles. For example, the metal catalyst may be configured as an annulus into which is received a cylinder of abrasive crystal particles, or as a disc which is disposed above or below the crystalline mass. Alternatively, the metal catalyst, or solvent as it is also known, may be provided in a powdered form and intermixed with the abrasive crystalline particles, or as a cemented metal carbide or carbide molding powder which may be cold pressed into shape and wherein the cementing agent is provided as a catalyst or solvent for diamond recrystallization or growth. Typically, the metal catalyst is selected from cobalt, iron, or nickel, or an alloy or mixture thereof, but other metals such as ruthenium, rhodium, palladium, chromium, manganese, tantalum, copper, and alloys and mixtures thereof also may be employed.

Under the specified HT/HP conditions, the metal catalyst, in whatever form provided, is caused to penetrate or "sweep: into the abrasive layer by means of either diffusion or capillary action, and is thereby made available as a catalyst or solvent for recrystallization or crystal intergrowth. The HT/HP conditions, which operate in the diamond stable thermodynamic region above the equilibrium between diamond and graphite phases, effect a compaction of the abrasive crystal particles which is characterized by interrystalline diamond-to-diamond bonding wherein parts of each crystalline lattice are shared are shared between adjacent crystal grains. Preferably, the diamond concentration in the compact or in the abrasive table of the supported compact is at least about 70% by volume. Methods for making diamond compacts and supported compacts are more fully described in U.S. Pat. Nos. 3,142,746; 3,745,623; 3,609,818; 3,850,591; 4,394,170; 4,403,015; 4,797,326; and 4,954,139.

Regarding the sintering of polycrystalline CBN compacts and supported compacts, such compacts and supported compacts are manufactured in general accordance with the methods suitable for diamond compacts. However, in the formation of CBN compacts via the previously described "sweep-through" method, the metal which is swept through the crystalline mass need not necessarily be a catalyst or solvent for CBN recrystallization. Accordingly, a polycrystalline mass of CBN may be joined to the cobalt-cemented tungsten carbide substrate by the sweep through of the cobalt from the substrate and into the interstices of the crystalline mass notwithstanding that cobalt is not a catalyst or solvent for the recrystallization of CBN. Rather, the interstitial cobalt functions as a binder between the polycrystalline CBN compact and the cemented tungsten carbide substrate.

As it was for diamond, the HT/RP sintering process for CBN is effected under conditions in which CBN is the thermodynamically stable phase. It is speculated that under these conditions, intercrystalline bonding between adjacent crystal grains also is effected. The CBN concentration in the compact or in the abrasive table of the supported compact is preferably at least about 50% by volume. Methods for making CBN compacts and supported compacts are more fully described in U.S. Pat. Nos. 2,947,617; 3,136,615; 3,233,988; 3,743,489; 3,745,623; 3,831,428; 3,928,219;

4,188,194; 4,289,503; 4,673,414; 4,797,326; and 4,954,139. Exemplary CBN compacts are disclosed in U.S. Pat. No. 3,767,371 to contain greater than about 70% by volume of CBN and less than about 30% by volume of a binder metal such as cobalt.

As is describe in U.S. Pat. No. 4,344,928, yet another form of a polycrystalline compact, which form need not necessarily exhibit direct or intercrystalline bonding, involves a polycrystalline mass of diamond or CBN particles having a second phase of a metal or alloy, a ceramic, or a mixture thereof. The second material phase is seen to function as a bonding agent for abrasive crystal particles. Polycrystalline diamond and polycrystalline CBN compacts containing a second phase of a cemented carbide are exemplary of the conjoint" polycrystalline abrasive compacts. Such compacts may be considered to be "thermally-stable as compared to metal-containing compacts as having service temperatures above about 700° C. Compacts as those described in U.S. Pat. No. 4,334,928 to comprise 80 to 10% by volume of CBN and 20 to 90% by volume of a nitride binder such as titanium nitride also may be considered exemplary of a thermally-stable material.

Supported PCD and CBN compacts have garnered wide acceptance for use in cutting and dressing tools, drill bits, and in like applications wherein the hardness and wear properties of such compacts are exploited. In particular, such compacts have been incorporated into dies for drawing feedstocks of such metals as tungsten, copper, iron, molybdenum, and stainless steel into wires. Typically, these wire drawing dies are surrounded by and bonded to an generally annular, outer mass of a metal carbide support. Provided to extend through the compact along the axial centerline thereof is a hole or other aperture into which the metal feedstock is drawn for its elongation into a wire product of a reduced diameter. Wire drawing dies of such general type and methods for manufacturing the same are described in U.S. Pat. Nos. 3,831,428; 4,016,736; 4,129,052; 4,144,739; 4,303,442; 4,370,149; 4,374,900; 4,534,934; 4,828,611; 4,872,333; and 5,033,334.

With respect to the fabrication of the wire drawing dies herein involved, although a variety of methods may be employed, HT/HP sintering processes as are described in U.S. Pat. Nos. 3,831,428 and 4,534,934 may be considered preferred. As with fabrication of supported compacts in general, the preferred HT/HP processes entail the sweep of a catalytic or binder metal, such as cobalt, through a mass of CBN or PCD particles. For wire die forming processes, the particles are charged within a support of a surrounding metal carbide annulus. At the processing conditions heretofore specified, metal from the support and, optionally, from an axially disposed disc, is made to infiltrate radially and/or axially into the interstices of the crystalline mass. Within the particle mass, the infiltrated metal forms a separate binder phase and, at least with respect to PCD, effects significant intercrystalline bonding. The metal additionally joins the sintered compact to the support to form an integral structure. The wire drawing hole may be formed through the sintered compact as a finishing step by laser drilling or other machining techniques. Alternatively, the hole may be preformed by including a wire as axially disposed within the particle mass, which wire is removed after the sintering of the mass by dissolution in a suitable acid or other solvent or by machining techniques.

As to supported compacts in general, it is speculated, as is detailed in U.S. Pat. No. 4,797,326, that the bonding of the support to the polycrystalline abrasive mass involves a physical component in addition to a chemical component which develops at the bondline if the materials forming the respective layers are interactive. The physical component of bonding is seen to develop from a relatively lower coefficient of thermal expansion (CFE) of the polycrystalline abrasive layer as compared to the cemented metal support layer. That is, upon the cooling of the supported compact blank from the HT/HP processing conditions to ambient conditions, it has been observed that the support layer retains residual tensile stresses which, in turn, exert a radial compressive loading on the polycrystalline compact supported thereon. This loading maintains the polycrystalline compact generally in compression which thereby improves the fracture toughness, impact, and shear strength properties of the laminate. In a wire die configuration, the support annulus has been observed, generally, to beneficially exert both a radial and an axial compression against the central polycrystalline core. However, localized regions of residual tensile stress are known to be present in the throat or reduction zone of the wire die.

During drawing operations, however, there are known to be developed frictional normal forces as between the contacting surfaces of the die and the wire being drawn. Such forces develop stresses which have been observed to combine with the residual stresses of the HT/HP forming process to deleteriously affect the operational life and performance properties of the die. Failure has been seen to occur principally within the bore of the die, or at the external, i.e. axial surfaces of the compact layer.

Moreover, in the commercial production of supported compacts in general, it is common for the product or blank which is recovered from the reaction cell of the HT/HP apparatus to be subjected to a variety of finishing operations which include cutting, such as by electrode discharge machining or with lasers, milling, and especially grinding to remove any adherent shield metal from the outer surfaces of the compact. Such operations additionally are employed to machine the compact into a cylindrical shape or the like which meets product specifications as to diamond or CBN abrasive, table thickness and/or carbide support thickness. With respect to wire drawing dies in particular, prior to use, the die generally is brazed into a receiving ring or other support assembly. It will be appreciated, however, that during such finishing and brazing operations, the temperature of the blank, which previously has been exposed to a thermal cycle during its HT/HP processing and cooling to room temperature, can be elevated due to the thermal effects of the operations. During each of the thermal cycles, the carbide support, owing to its relatively higher coefficient of thermal expansion (CTE), will have expanded to a greater extent than the abrasive compact supported thereon. Upon heating and cooling, the stresses generated are relieved principally through the deformation of the compact layer which may result in its stress cracking and delamination from its support.

Proposals have been made to improve the performance of supported compact wire drawing dies. In this regard, U.S. Pat. No. 4,374,900 suggests surrounding the circumference of the diamond compact with a cermet material which contains molybdenum as a predominant component. The cermet is stated to have a high degree of plastic deformation and a high rigidity at elevated temperatures. U.S. Pat. No. 5,033,334 discloses a wire drawing die wherein the outer surface of the compact is metallized and then brazed to the mating surface of the support. Such die is stated to have an improved bond strength as between the compact and support components.

Recently, commonly-assigned U.S. Pat. No. 5,660,075 (the '075 patent") proposed to improve the physical properties of wire drawing dies by making the carbide support/polycrystalline diamond interface extend radially from the longitudinal axis center of the die a minimum distance at a region intermediate between the entrance end and the exit end of the die, such as is depicted in FIG. 2, which will be described in detail below. While this reduces the residual tensile stresses on die bore surfaces, it is more expensive to make than conventional wire drawing dies, such as is depicted in FIG. 1, which also will be described in detail below.

Notwithstanding the prior proposals, additional improvements in wire drawing dies would be well-received by industry. Especially desired would be a die having reduced residual stresses and, correspondingly, an extended service life, a reduced susceptibility to failure, and improved machinability performance, and wear properties. Thus, there has been and heretofore has remained a need for wire drawing dies having improved physical properties.

BRIEF SUMMARY OF THE INVENTION

PCD commonly is used as a die material in drawing metal wire such as, for example, copper and its alloys, various steels, and other precious metals. In the drawing of high tensile steel, for example, a common failure mode is the formation of a wear ring in the entrance or reduction region of the die where the wire first contacts the, diamond material. During use, this wear ring moves down the axis of the die until it eventually causes breakage of the wire, imparts unfavorable residual stresses in the wire, or results in an out-of-shape product.

To increase the life of wire drawing dies, it is desirable to decrease the rate of wear ring formation. The wear ring presumably forms by successive pitting of the PCD or other material surface which typically is under tensile stresses. If these tensile stresses can be reduced or changed to compressive stresses, the rate of wear ring formation should be slowed during operation.

The present invention, then, is based on the discovery that by making the carbide annulus/polycrystalline component interface surface extend inwardly from the entrance end of the die to the vicinity of the wear ring location, that stresses in the compact can be materially diminished which should lead to longer service life. Moreover, the interface configuration for the remaining die down to the exit end is much less important and can, for example, remain in a conventional cylindrical configuration. While the performance of the present wire drawing die may not reach that of the wire drawing die disclosed in '075 patent, its expected lower production costs and ease of manufacture should make it an attractive alternative product which is much improved over conventional cylindrical interface wire drawing die products.

Accordingly, the present invention is addressed to improving a blank for converting into a wire drawing die which is formed from an annular cemented metal carbide support component having a lengthwise extent from an entrance end to an exit end and extending radially about a central longitudinal axis to define a cylindrical internal bore through the lengthwise extent, and a cylindrical sintered polycrystalline compact component received within the bore of the support component and bonded thereto at an interface surface extending a radial distance from and along the longitudinal axis from a wire drawing entrance end to a wire drawing exit end. The compact component is adapted to receive an aperture extending through its lengthwise extent about the central longitudinal axis and is configured with an entrance zone at the die entrance end which tapers inwardly therefrom to a reduction zone whereat a wire to be drawn through the aperture makes initial contact with the compact component, and thence to a bearing zone and an exit zone. The improvement in such wire drawing die blank revolves around the radial distance from said central longitudinal axis to said interface surface tapers inwardly from the entrance end to a minimum prior to the bearing zone after which said radial distance remains substantially constant to said exit end.

Another aspect of the present invention is addressed to improving a wire drawing die formed from an annular cemented metal carbide support component having a lengthwise extent from an entrance end to an exit end and extending radially about a central longitudinal axis to define a cylindrical internal bore through the lengthwise extent, and a cylindrical sintered polycrystalline compact component received within the bore of the support component and bonded thereto at an interface surface extending a radial distance from and along the longitudinal axis from a wire drawing entrance end to a wire drawing exit end. The compact component has an aperture extending through its lengthwise extent about the central longitudinal axis and is configured with an entrance zone at the die entrance end which tapers inwardly therefrom to a reduction zone whereat a wire to be drawn through the aperture makes initial contact with the compact component, and thence to a bearing zone and an exit zone. The improvement in such wire drawing die revolves around the radial distance from said central longitudinal axis to said interface surface tapers inwardly from the entrance end to a minimum prior to the bearing zone after which said radial distance remains substantially constant to said exit end.

As a further aspect of the present invention is a process for forming a wire drawing die blank formed by a high pressure/high temperature (HP/HT) process. This process commences by providing a reaction cell assembly which includes an annular cemented metal carbide support component having a lengthwise extent from an entrance end to an exit end and extending radially about a central longitudinal axis to define a cylindrical internal bore through the lengthwise extent. The reaction cell assembly also includes a sinterable mass of crystalline particles received within the bore of the support component. The process continues by subjecting the reaction cell assembly to HP/HT conditions selected as being effective to sinter the mass of crystalline particles into a polycrystalline compact which compact is adapted to have an aperture extending through its lengthwise extent about the central longitudinal axis and configured with an entrance zone at the entrance end which tapers inwardly therefrom to a reduction zone whereat a wire to be drawn through the aperture makes initial contact with said compact component, and thence to a bearing zone and an exit zone. The HP/HT conditions also are selected as being effective to bond the compact to the support component at an interface surface extending along the longitudinal axis wherein the radial distance from said central longitudinal axis to said interface surface tapers inwardly from the entrance end to a minimum prior to the bearing zone after which said radial distance remains substantially constant to said exit end.

Advantages of the present invention include the provision of a wire drawing die and blank therefor which have residual stresses which are controlled to promote an extended service life, and reduced susceptibility to failure. Another advantage is a wire drawing die and blank therefor having improved machinability, performance, and wear properties. These and other advantages will become readily apparent to those skilled in the art based upon the instant disclosure.

BRIEF DESCRIPTION OF THE DRAWINGS

For a fuller understanding of the nature and advantages of the invention, reference should be had to the following detailed description taken in connection with the accompanying drawings wherein.

The drawings will be described further in connection with the following description of the present invention.

DETAILED DESCRIPTION OF THE INVENTION

Figure 1:
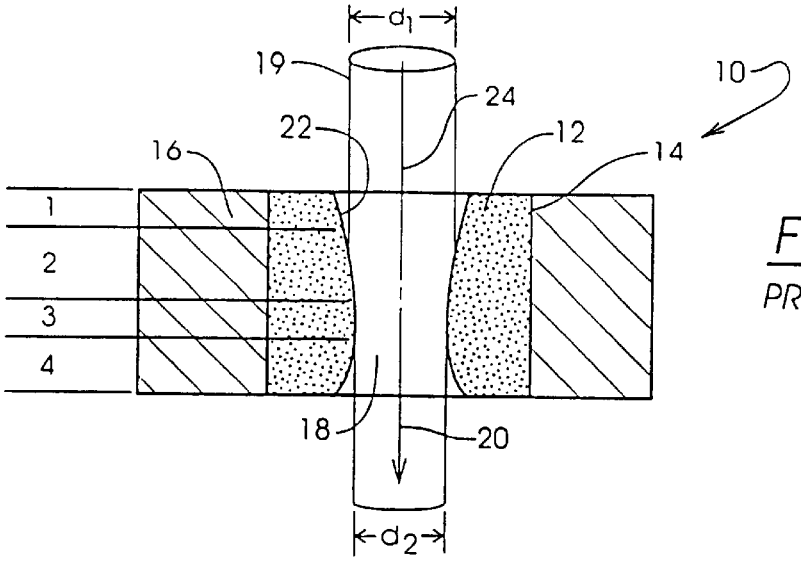
FIG. 1 PRIOR ART
FIG. 1 is a cross-sectional view of a wire drawing die fabricated in accordance with the prior art as ming a generally cylindrical interface as between an inner compact and an outer support component.

Referring to FIG. 1, a wire drawing die substantially in accordance with the prior art is shown at 10 to include inner, polycrystalline compact component 12, bonded at interface or bondline 14, to cemented metal carbide support layer 16. A wire drawing aperture or throat, represented at 18, is provided in to extend through compact component 12 for receiving the wire being drawn. In this regard, wire feedstock 19 of a given diameter, d,, is drawn through aperture 18 in the direction shown by arrow 20 for elongation into a wire product of reduced diameter, $d_2$. Drawing aperture 18 preferably is configured as being tapered either doubly or piecewise to define a characteristic surface of revolution about central longitudinal axis 24 for confronting wire 19 being drawn. Area or region 22 at which wire 19 initially contacts compact component 12 is the wear ring described above. During use, wear ring 22 moves down axis 24 of die 10 until it eventually causes breakage of wire 19, imparts unfavorable residual stresses in wire 19, or results in an out-of-shape product. To increase the life of wire drawing dies, it is desirable to decrease the rate of wear ring formation. Wear ring 22 presumably forms by successive pitting of the surface of compact component 12 which typically is under local tensile stresses. If these tensile stresses can be reduced or changed to compressive stresses, the rate of wear ring formation should be slowed during operation. Based on the foregoing description, the art generally recognizes four distinct zones for wire drawing die 10; entrance zone 1, reduction zone 2, bearing zone 3, and exit zone 4.

Figure 2:
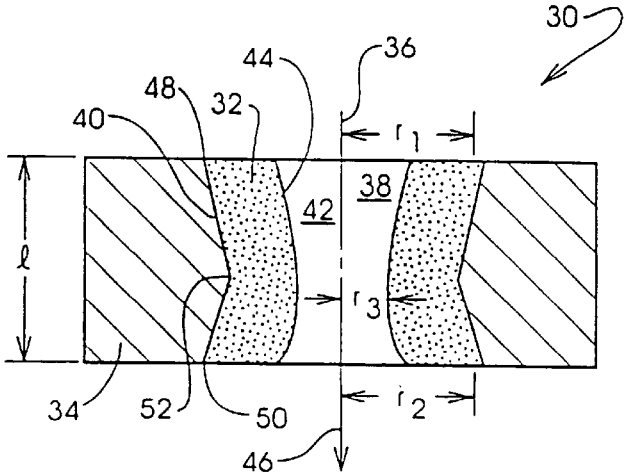
FIG. 2 PRIOR ART
FIG. 2 is a cross-sectional view of a wire drawing die fabricated in accordance with the '075 patent as having an interface surface extending along a longitudinal axis from a first end spaced a first local maximum radial distance from said axis to a second end spaced a second local maximum radial distance from the axis, wherein the interface surface radially extends inwardly from said first and said second ends to define an intermediate ret therebetween spaced a local minimum radial distance from the axis.

Referring to FIG. 2, a prior art wire drawing die substantially in accordance with the '075 patent is shown at 30 to include inner sintered polycrystalline compact component 32 and outer support component 34. Support component 34 is configured as having a lengthwise extent, l, and as extending about central longitudinal axis 36 to define internal bore 38 therethrough. Compact component 32 is received within bore 38 of support component 34 and is bonded thereto at interface surface 40. As before, a wire drawing aperture or throat, represented at 42, defining a generally tapered surface of revolution 44 about axis 36, is provided through compact component 32 for receiving a wire (not shown) drawn therethrough in the direction shown at arrow 46 substantially in the same manner as described in connection with FIG. 1. However, interface 40 now extends along axis 36 from entrance end 48, spaced a first local maximum radial distance, $r_1$, from axis 36, to exit end 50, spaced a second local maximum radial distance, $r_2$, from axis 46. Intermediate region 52 is shown spaced a local minimum radial distance, $r_3$, from axis 36. Again, while not shown on FIG. 2, the four zones described above are present here also.

Figure 3:
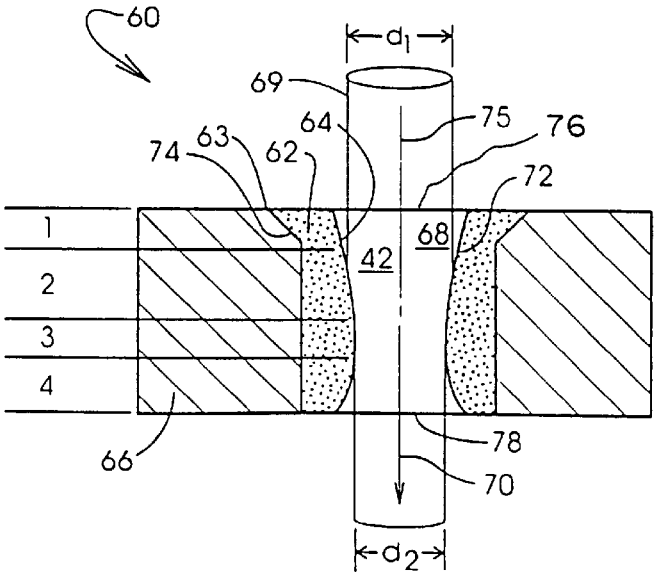
FIG. 3 is a cross-sectional view of a wire drawing die fabricated in accordance with the present invention as having a generally non-cylindrical interface as between the inner compact and outer support component from the entrance end of the die to the intermediate w ring location.

Now, referring to FIG. 3, inventive wire drawing die 60 is seen to include inner polycrystalline compact 62 bonded at interface or bondline 63, to cemented metal carbide support layer 66. A wire drawing aperture or throat, represented at 68, defining a generally tapered surface of revolution 64 about axis 75, is provided to extend through compact component 62 for receiving the wire being drawn. In this regard, wire feedstock 69 of a given diameter, dI, is drawn through aperture 68 in the direction shown by arrow 70 for elongation into a wire product of reduced diameter, $d_2$. Drawing aperture 68 preferably is configured as being tapered either doubly or piecewise to define a characteristic surface of revolution about central longitudinal axis. 75 for confronting wire 69 being drawn. Area or region 72 at which wire 69 initially contacts compact component 72 is the wear ring described above.

The local stresses exerted by wire 69 at wear ring 72 can be accommodated by configuring interface 74 to taper from entrance end 76 where the radial distance from longitudinal centerline 75 to interface 74 is a distance, $r_e$, to wear ring 72 where the radial distance from longitudinal centerline 75 to interface 74 is a distance, $r_{wr}$, where $r_e > r_{wr}$. In other words, the taper for interface 74 should be ahead of bearing zone 3, i.e., in entrance zone 1 or reduction zone 2. It will be observed that interface 74 from wear ring 72 to exit end 78 (bearing zone 3 and exit zone 4) retains the substantially cylindrical configuration of interface 74 of prior art compact 10 in FIG. 1. Thus, the extra expense to configure interface 74 in the shown tapered configuration need only be applied to entrance zone 1 and/or reduction zone 2 of wire die 60, i.e., ahead of bearing zone 3. This is expected to moderate the costs associated with the double taper required for the '075 wire die shown in FIG. 2.

Figure 4:
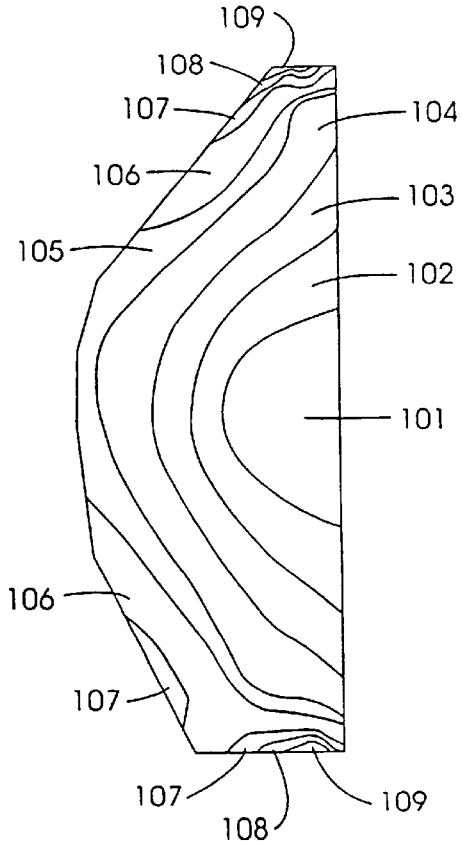
FIG. 4 is a graphical representation of a finite element model of the maximum principle stress distributions in a section of the prior art representative wire drawing die of FIG. 1 which has a cylindrical interface.
Figure 5:
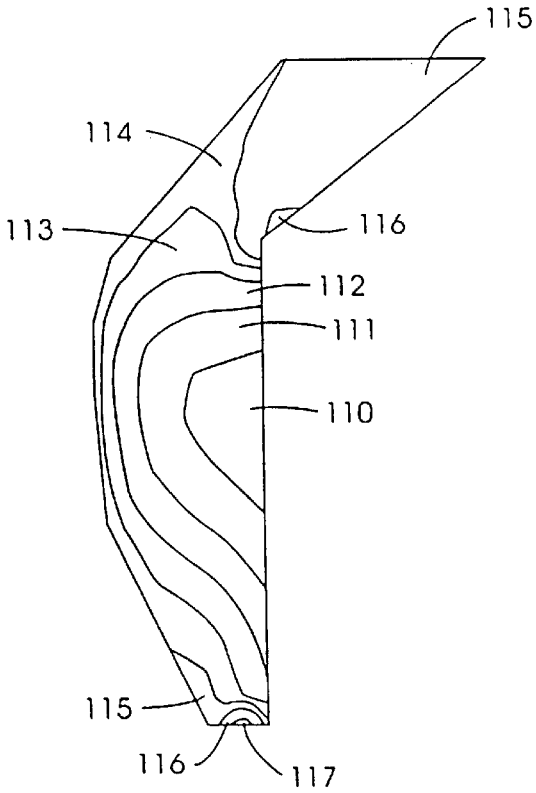
FIG. 5 a graphical representation of a finite element model of the maximum principle stress distributions in a section of the novel representative wire drawing die of FIG. 3.

With respect to the moderation in local stresses achieved by the inventive wire drawing die configuration, reference is made to FIGS. 4 and 5 wherein a somewhat stylized representation of a finite element model of the maximum principle stress distributions in a section of a wire drawing die compact are shown for the generally cylindrical interface of compact 10, FIG. 4, and for the novel singly entrance zone taper of compact 60, FIG. 5. Each of the sections are shown as having a maximum principle stress distribution graphically depicted by the contours designated 101–109 in FIG. 4 and 110–117 in FIG. 5. In prior art wire drawing die 10 in FIG. 4, local stresses 101–105 represent compression stresses, while local stresses 106–109 represent tension stresses, with the local stresses generally increasing in tension as the numeric designations increase.

Referring to FIG. 5, local stresses 110–114 represent compressive stresses, while local stresses 115–117 represent tension stresses. Thus, it will be observed that at entrance zone 1 and reduction zone 2, the local tensile stresses have been reduced.

This is expected to minimize wear ring formation. In the bearing and exit zones, the local force distribution patterns are about the same in FIGS. 4 and 5; however, wire drawing failures in these zones are not as common. Thus, the present invention addresses a dominant failure mode for wire drawing dies to configuring the interface to substantially reduce, if not eliminate, wear ring formation, while concomitantly not increasing costs of production of the wire die unnecessarily.

What is claimed is:

1. In a process for forming a wire drawing die blank formed by a high pressure/high temperature (HP/HT) process, the improvement which comprises:

(a) providing a reaction cell assembly comprising:

(i) an annular cemented metal carbide support component having a lengthwise extent from an entrance end to an exit end and extending radially about a central longitudinal axis to define a cylindrical internal bore through said lengthwise extent; and (ii) a compact component comprising a sinterable mass of crystalline particles received within said bore of said support component; and (b) subjecting said reaction cell assembly to HP/ HT conditions selected as being effective (i) to sinter said mass of crystalline particles into a polycrystalline compact which compact is adapted to have an aperture extending through its lengthwise extent about said central longitudinal axis and configured with an entrance zone at said entrance end which tapers inwardly therefrom to a reduction zone whereat a wire to be drawn through said bore makes initial contact with said compact component and thence to a bearing zone and an exit zone, and (ii) to bond said compact to said support component at an interface surface extending along said longitudinal axis wherein the radial distance from said central longitudinal axis to said interface surface tapers inwardly from the entrance end to a minimum prior to the bearing zone after which said radial distance remains substantially constant to said exit end.

2. The improved process of claim 1, wherein said sintered polycrystalline compact component comprises diamond particles, CBN particles, or a mixture thereof.

3. The improved process of claim 2, wherein said sintered polycrystalline compact component comprises between about 10% to 30% by volume of a binder metal selected from the group consisting of cobalt, nickel, and iron, and mixtures and alloys thereof.

4. The improved process of claim 1, wherein said metal carbide support component comprises carbide particles selected form the group consisting of tungsten, titanium, tantalum, and molybdenum carbide particles, and mixtures thereof.

5. The improved process of claim 1, wherein said metal carbide support component comprises a binder metal selected from the group consisting of colbalt, nickel, and iron, and mixtures and alloys thereof.

* * * * *